United States Patent [19]

O'Brien

[11] Patent Number: 4,824,067

[45] Date of Patent: Apr. 25, 1989

[54] REMOVABLE OUTBOARD MOTOR BRACKET FOR A BOAT SWIM PLATFORM

[76] Inventor: Timothy P. O'Brien, 6748 Donnybrook, Utica, Mich. 48087

[21] Appl. No.: 215,332

[22] Filed: Jul. 5, 1988

[51] Int. Cl.[4] ..... F16M 1/00

[52] U.S. Cl. ..... 248/642; 440/900

[58] Field of Search ..... 248/642, 640, 641, 643, 248/284; 440/63, 53, 900

[56] References Cited

U.S. PATENT DOCUMENTS

| | | | |
|---|---|---|---|
| 3,032,304 | 5/1962 | Machlan | 248/641 |
| 3,930,461 | 1/1976 | Brock et al. | 248/642 X |
| 3,948,472 | 4/1976 | Metcalf | 248/642 X |
| 3,990,660 | 11/1976 | Pipoz | 248/642 |
| 4,306,703 | 12/1981 | Finze | 248/642 |
| 4,354,848 | 10/1982 | Hall et al. | 248/642 X |
| 4,634,390 | 1/1987 | Baird | 440/63 |
| 4,733,848 | 3/1988 | Slattery | 440/53 X |

*Primary Examiner*—Ramon O. Ramirez

*Attorney, Agent, or Firm*—Robert G. Mentag

[57] ABSTRACT

A removable outboard motor bracket that mounts on a swim platform on the rear end of a power boat, and which permits an outboard motor carried on the bracket to be lowered into the water for use and raised vertically out of the water when not in use, and which can be quickly and easily removed for storage purposes.

7 Claims, 3 Drawing Sheets

REMOVABLE OUTBOARD MOTOR BRACKET FOR A BOAT SWIM PLATFORM

BACKGROUND OF THE INVENTION

1. Technical Field

The field of art to which this invention pertains may be generally located in the class of devices relating to supports. Class 428, Subclass 640, Outboard Motor Supports, United States Patent Office Classifications, appears to be the applicable general area of art to which the subject matter similar to this invention has been classified in the past.

2. Background Information

It is well known in the power boating art to provide an auxiliary outboard motor for trolling and other purposes. In many instances the auxiliary outboard motor is attached to a swim platform mounted on the aft end of the power boat. The prior art mounts for mounting an outboard motor on a swim platform are all mounted in such a manner that when it is desired to discontinue use of the auxiliary outboard motor, the motor must be tipped to an inoperative horizontal position so that the boat may then be propelled by the regular propulsion unit. Under such circumstances the motor shaft with the propeller protrudes rearwardly behind the boat to as much as three feet and when the boat is swung around or maneuvered, a safety hazard is created since the rearwardly protruding outboard motor structure may hit pilings, a dock or other boats. The problem solved by the present invention is the elimination of the aforementioned safety hazard created by a protruding inactive outboard motor attached to the swim platform of a power boat.

Examples of prior art outboard motor supporting devices which include outboard motor supporting linkages are disclosed in the following U.S. Pat. Nos.: Machlan 3,032,304 issued May 1, 1962; Horton 3,674,228 issued July 4, 1972; Langley 3,874,318 issued Apr. 1, 1975; Brock, et al 3,930,461 issued Jan. 6, 1976; Metcalf 3,948,472 issued Apr. 6, 1976; Pipoz 3,990,660 issued Nov. 9, 1976; Meyer et al 4,013,249 issued Mar. 22, 1977; Alter 4,279,6032 issued July 21, 1981; Baird 4,634,390 issued Jan. 6, 1987.

SUMMARY OF THE INVENTION

The invention provides a removable outboard motor bracket which is adapted to be mounted to a swim platform on the back of a power boat. The outboard motor bracket enables an outboard motor to be lowered into the water for use, and raised to a substantial vertical position out of the water when not in use. The outboard motor bracket includes a mounting means which is adapted to be seated on the upper surface of a swim platform on the back of a power boat, and retainer means for removably securing the mounting means to the swim platform. The outboard motor bracket further includes a linkage assembly which comprises a front link and a rear link. The lower ends of the front and rear links are pivotally mounted to the mounting means. The upper ends of the front and rear links are pivotally mounted to an outboard motor mounting pad attachment bracket means. A locking lever has a lower end pivotally attached to the mounting means, and is operatively connected with the linkage assembly so as to lock the linkage assembly in the lowered outboard motor position as well as in the raised or "up" outboard motor storage position.

One of the principal features of the invention is the provision of a removable outboard motor mounting bracket which affords movement of the motor between an operating position and a storage position with minimum effort.

Another feature of the invention is the provision of such a mounting bracket which affords substantially vertical movement of the motor during travel from the operating position towards the storage position.

DESCRIPTION OF THE PREFERRED EMBODIMENTS

Figure 2:
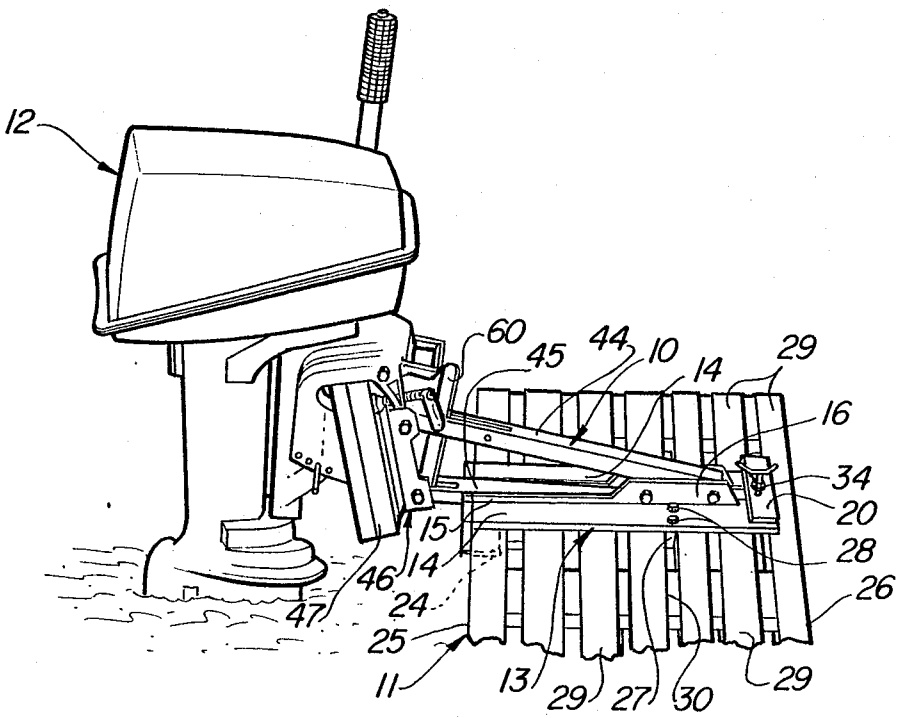
FIG. 2 is a view similar to FIG. 1, but showing the removable outboard motor bracket in a lowered position to hold an outboard motor in an operative position in the water.
Figure 1:
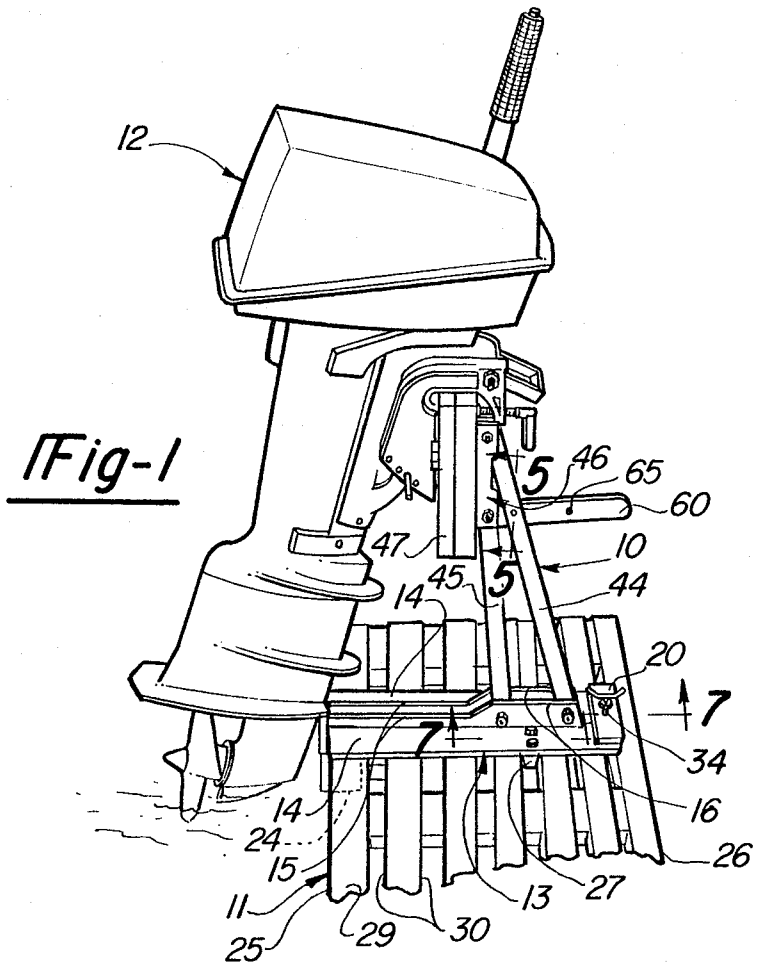
FIG. 1 is an elevation perspective view of a removable outboard motor bracket made in accordance with the principles of the present invention, and showing the bracket in an elevated or motor storage position on a power boat a swim platform.

Referring now to the drawings, and in particular to FIG. 1, the numeral 10 generally designates an outboard motor bracket, made in accordance with the principles of the present invention. The numeral 11 generally designates a conventional swim platform which is secured to the aft end or transom of a power boat. The numeral 12 generally designates a conventional outboard motor which is carried by the outboard motor bracket 10. FIG. 1 shows the outboard motor 12 in an elevated or motor storage position, and FIG. 2 shows the outboard motor 12 in a lowered position for operation in the water.

Figure 3:
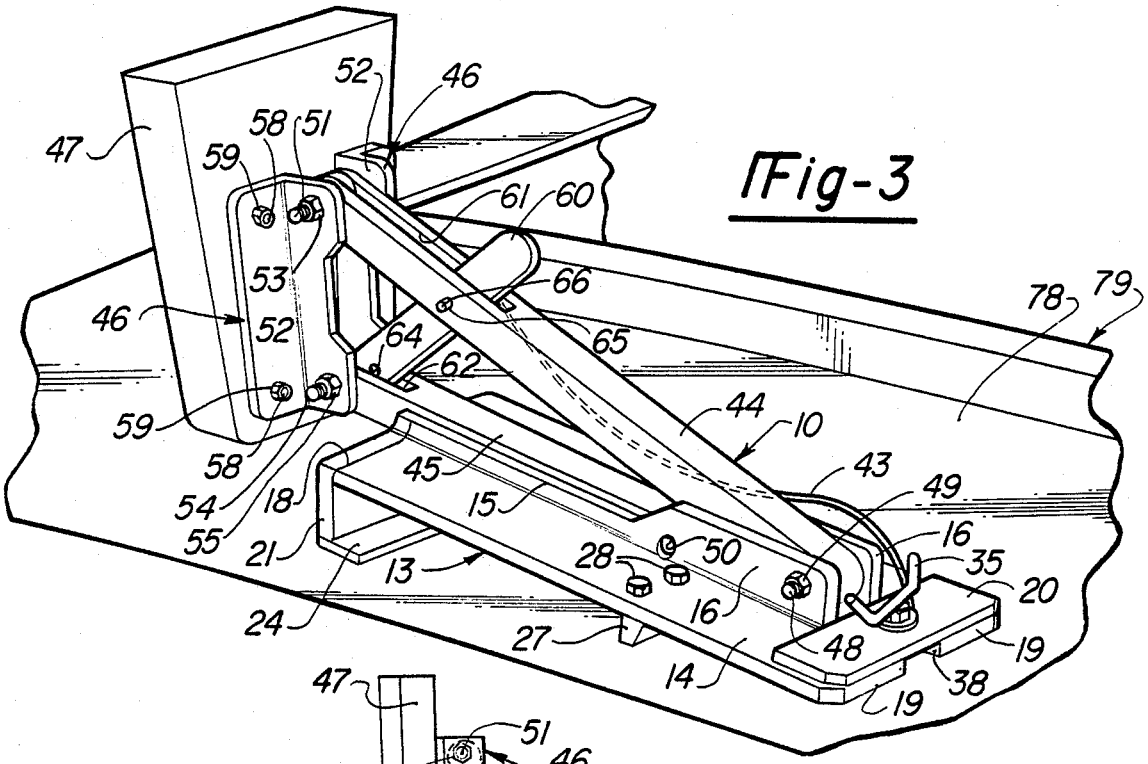
FIG. 3 is an elevation perspective view of a removable outboard motor bracket made in accordance with the principles of the present invention and showing the bracket removed and positioned on the deck of a motor boat.

The outboard motor bracket 10 includes a mounting member or mounting means generally indicated by the numeral 13. The bracket mounting member 13 includes a pair of elongated horizontal plates 14 which are laterally spaced apart. As shown in FIG. 3, each of the mounting member plates 14 is provided with an integral vertical flange 15 of a first height which extend from the rear end 18 of the plate 14 toward the rear end 19. A second vertical flange 16 of a greater height is integrally formed on each plate 14 and it is integral with the front end of the first named flange 15. The flange 16 terminates at a point spaced rearwardly from the front end 19 of each plate 14.

The spaced apart mounting plates 14 are fixedly connected at their front ends by a transverse connector plate 20 which is disposed over the top front end portions of the plates 14 and fixedly secured thereto by any suitable means, as by welding. As best seen in FIG. 3, the rear ends of the mounting plates 14 are secured together by a transverse, vertical plate 21 which is fixedly secured to the plates 14 by any suitable means, as by welding. It will be understood that the aforementioned parts of the bracket mounting member 13 may be made from any suitable material, as for example, from aluminum, or stainless steel. The hereinafter described other parts of the outboard motor bracket 10 may also be made from any suitable material, as for example, aluminum or stainless steel, and from any suitable structural shape as for example, round or squared tubing, and angle iron.

The bracket mounting member 13 is releasably secured to the swim platform 11 by the following described retainer means. A horizontal, transverse plate 24 is fixedly secrued to the lower end of the transverse, vertical plate 21 by any suitable means, as by welding. As shown in FIG. 1, when the outboard motor bracket 10 is positioned on the swim platform 11, the horizontal plate 24 is positioned under the swim platform 11 and the vertical, transverse plate 21 is positioned against the rear, transverse end 25 of the swim platform 11. It will be seen that the vertical, transverse plate 21 and the horizontal, transverse plate 24 thus function with the mounting plates 11 to from a C-shaped retainer member which seats over the rear end 25 of the swim platform 11 and retains the outboard motor bracket 10 against movement toward the front end 26 of the swim platform 11. The last described retainer structure also restrains the rear end of the outboard motor bracket 10 from movement upward or downward relative to the swim platform 11. It will be understood that the vertical space between the transverse plate 24 and the mounting plates 14 is made to a dimension commensurate with the thickness of the swim platform 11, so as to provide a snug fit between the plate 24 and the mounting plates 14.

Figure 7:
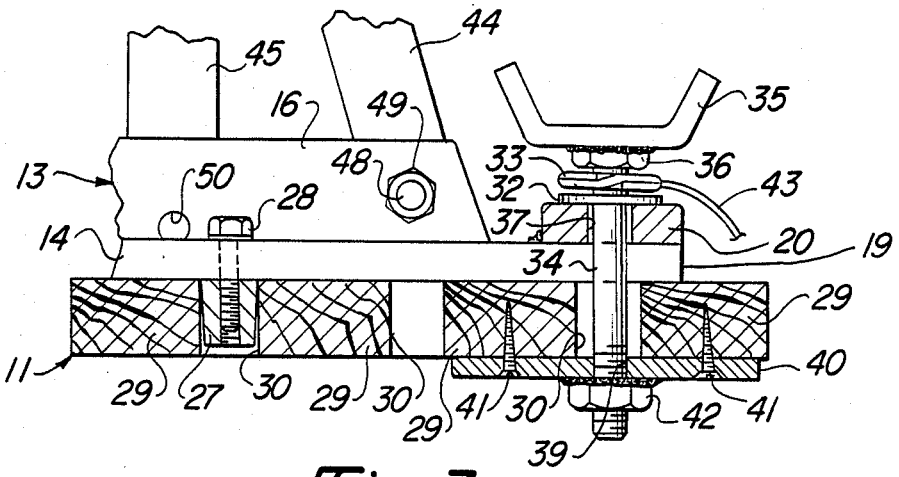
FIG. 7 is a fragmentary, enlarged, elevation section view of the removable outboard motor bracket structure illustrated in FIG. 1, taken along the line 7—7 thereof, and looking in the direction of the arrows.

As best seen in FIGS. 2, 3 and 7, the outboard motor bracket 10 is provided with a further retainer member 27 which comprises a transverse bar made of any suitable material, as for example, aluminum. The transverse retainer bar 27 is fixedly secured to each of the mounting plates 14 by any suitable means, as by a pair of suitable machine screws 28. As shown in FIGS. 2 and 7, the transverse retainer member or bar 27 is adapted to be seated in a transverse slot 30 formed between a pair of the transverse wood strips 29 which form the swim platform 11. The retainer member 27 prevents fore and aft movement of the outboard motor bracket 10.

As shown in FIGS. 1, 2 and 7, the retainer means for the outboard motor bracket 10 further includes a retainer bolt 34 which is positioned at the front end of the outboard motor bracket 10. As shown in detail in FIG. 7, the retainer bolt 34 is provided with a substantially U-shaped handle 35 which is fixedly secured to a nut 36 by any suitable means, as by welding. The nut 36 is affixed by any suitable means, as by welding, to the upper end of the retainer bolt 34. The retainer bolt 34 is shown in FIG. 7 in a position to clamp or retain the rear end of the outboard motor bracket 10 in a fixed position on the swim platform 11. The retainer bolt 34 extends downwardly through a hole 37 formed through the transverse plate 20, and thence downwardly through the longitudinal opening 38 between the mounting plates 14, (FIG. 3) and then through one of the transverse slots 30 in the swim platform 11, and then through a hole 39 formed through a metal retainer plate 40. The metal retainer plate 40 is fixedly secured to the lower side of the swim platform 11 by any suitable means, as by a plurality of suitable wood screws 41. A nut 42 is fixedly secured, as by welding, to the lower side of the retainer plate 40, and the retainer bolt 34 is adapted to be threaded through the nut 42 for retaining the front end of the outboard motor bracket 10 securely in place on the swim platform 11. As shown in FIG. 7, one end 33 of a safety cable 43 is mounted around the upper end of the retainer bolt 34 in a position between the lower end of the nut 36, and the upper side of a washer 32. The washer 32 is fixedly secured to the retainer bolt 34 by any suitable means, as by welding.

The outboard motor bracket 10 further includes a linkage assembly comprising a front link 44, a rear link 45, and a pair of attachment brackets 46 which carry a wood pad or block 47 on which the outboard motor 12 is mounted in the conventional manner. As shown in FIG. 3, the lower end of the front link 44 is positioned in the opening 38 between the mounting plates 14. The lower end of the front link 44 is rotatably supported between the mounting plate flanges 16 by a suitable pivot shaft 48 which extends through suitable openings through the flanges 16 and the lower end of the lower link 44, and is secured in place by suitable nuts 49 on the ends thereof. As best seen in FIG. 3, the lower end of the rear link 45 is pivotally mounted in the opening 38 between the mounting plates 14 on a suitable pivot shaft 50 which is mounted in suitable openings in the mounting plate flanges 16 and secured in place by any suitable means, as by press fit.

As best seen in FIG. 3, the upper end of the front link 44 is rotatably mounted on a suitable pivot shaft 51 which is operatively mounted in suitable holes formed through the flanges 52 of the attachment brackets 46. The shaft 51 is held in position by suitable lock nuts 53. The upper end of the rear link 45 is also pivotally mounted between the flanges 52 of the attachment brackets 46 by a suitable pivot shaft 54 and lock nuts 55.

The attachment brackets 46 are laterally spaced apart as shown in FIG. 3, and they are each fixed to the front side of a wood pad 47 by a pair of suitable bolts 58 and lock nuts 59. As shown in FIG. 3, the upper ends of the links 44 and 45 are pivotally mounted between the attachment flange 52 at positions vertically spaced apart from each other, with the upper end of the upper link 44 positioned at the upper ends of the brackets 46.

As best seen in FIG. 3, a locking lever 60 is provided for locking the outboard motor bracket 10 in each of the elevated and lowered positions. The locking lever 60 is mounted with its upper end slidably positioned in a vertical slot 61 formed through the upper end of the upper link 44. The lower end of the locking lever 60 is slidably mounted in a similar vertical slot 62 formed through the upper end of the rear links 45. The lower end of the locking lever 60 is pivotally mounted on the rear link shaft 54.

Figure 4:
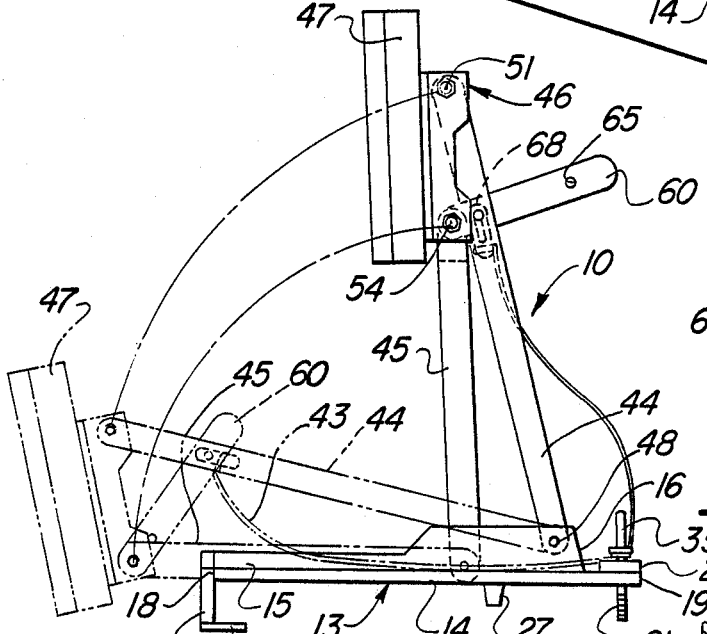
FIG. 4 is a side elevation view of the removable outboard motor bracket of the present invention and showing the bracket in a solid line elevated or "up" position, and in a broken-lined "down" or lowered position for holding an outboard motor in an operative position in the water.
Figure 5:
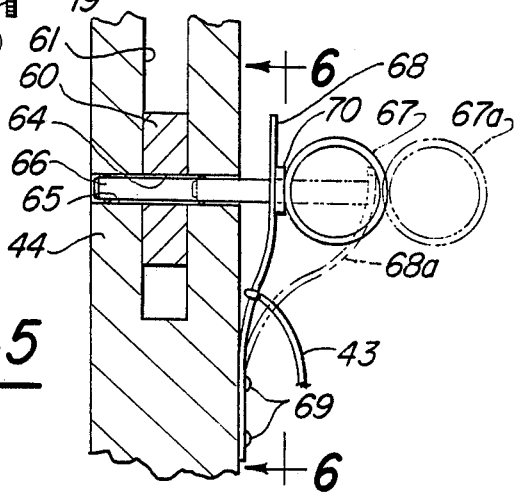
FIG. 5 is a fragmentary, enlarged, elevation section view of the structure shown in FIG. 1, taken along the line 5—5 thereof, looking in the direction of the arrows, and showing a safety pin and an associated safety pin retainer cable.

As shown in FIGS. 1, 4 and 5, when the outboard motor bracket 10 is moved to the elevated or "up" position, a lower hole 64 formed through the locking lever 60 is aligned with a hole 65 formed through the front link 44. A locking pin 66 is slidably mounted through the holes 65 and 64, and retains the outboard motor bracket 10 in the elevated or "up" position, and in a locked condition.

Figure 6:
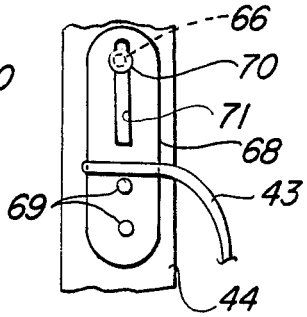
FIG. 6 is a fragmentary, elevational view of the structure illustrated in FIG. 5, taken along the line 6—6 thereof, and looking in the direction of the arrows.

As shown in FIG. 5, a pull ring 67 is fixed to the head of the locking pin 66 by any suitable means, as by welding. When it is desired to pull the locking pin 66 outwardly, or to the right, as shown in FIG. 5, to release the locking lever 60 from a locked position from the front link 44, the pull ring 67 is moved from the solid line position shown in FIG. 5 outwardly, or to the right, to the dotted line position indicated by the numeral 67*a*. As shown in FIGS. 5 and 6, a spring arm 68 has its lower end fixedly secured to one side of the front link 44 by a pair of suitable rivets 69. As best seen in FIG. 6, the spring arm 68 has a longitudinal slot 71 formed therethrough, through which the body of the pin 66 is mounted. The slot 71 permits the pin 66 to slide therein when the spring arm 68 is moved outwardly to the position 68*a* to allow the locking lever 60 to be released from the front link 44. As shown in FIGS. 4–6, the upper end of the safety cable 43 is secured around the lower end of the spring arm 68.

Figure 8:
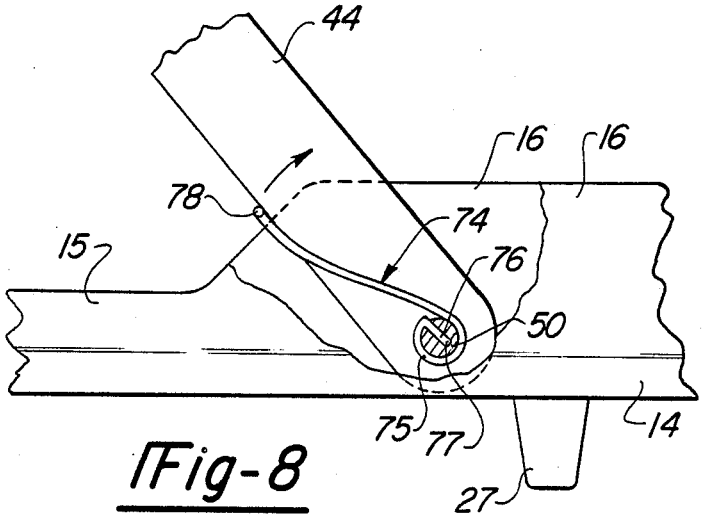
FIG. 8 is a fragmentary, enlarged view of a portion of the bracket mounting means, and one of the levers of the linkage assembly, and a spring means for urging the linkage assembly toward the elevated or "up" position.
Figure 9:
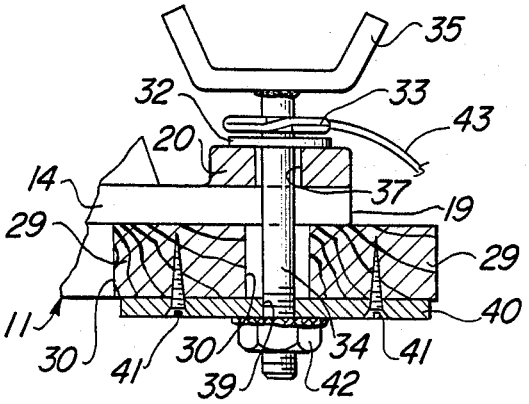
FIG. 9 is a fragmentary, elevation section view, similar to a portion of the structure of FIG. 7, and showing a modified retainer T-bolt.

FIG. 8 shows a modification of the invention in which an assist spring 74 is mounted on the rear link pivot shaft 50 for assisting the movement of the outboard motor bracket 10 to the "up" position shown in FIG. 1. The lower end 75 of the spring 74 is wound around the shaft 50 in a position just inwardly of one of the mounting flanges 16 with the extreme end thereof 76 mounted in a slot 77 formed in the periphery of the shaft 50. The upper end 78 of the spring 74 extends transversely of the outboard motor bracket 10 and engages the lower side of the front link 44. It will be seen that when the outboard motor bracket 10 is manually moved from the lowered position shown in FIG. 2 to the "up" position shown in FIG. 1, that the spring 74 will assist in the upward movement.

FIG. 8 shows a further modification of the invention in which the U-shaped handle 35 for the retainer bolt 34 is mounted directly on the upper end of the bolt 34 instead of on a nut 36 as shown in the first embodiment of FIG. 7.

Figure 10:
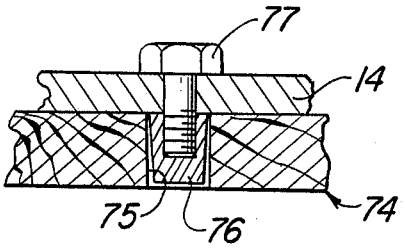
FIG. 10 is fragmentary, elevation section view of the mounting means and showing a modification thereof.

FIG. 10 shows a further embodiment of the invention which is adapted for use on a different swim platform 74 which is formed from a continuous piece of material such as wood, and with no slots, as the slots 30 formed in the swim platform 11. In the modification shown in FIG. 10, the transverse retainer bar 27 would be replaced by at least two cylindrical retainer lugs 76 which may be cylindrical in overall shape, but with a tapered peripheral surface to make them somewhat conical in cross section shape, as shown in FIG. 10. The cylindrical retainer lugs 76 would be positioned transversely in suitable holes 75 formed in the continuous surface swim platform 74. The lugs 76 would be retained in position on the bottom of the mounting plates 14 by suitable machine screws 77. It is preferable that at least two of the retainer lugs 76 be employed.

It will be seen that the outboard motor bracket 10 of the present invention is adapted to enable an outboard motor 12 to be mounted on a swim platform and to be lowered into the water for use, and to be raised vertically out of the water in a quick and easy manner. The bracket 10 is raised manually from the lowered position shown in FIG. 2, so as to raise the motor 12 to the "up" position shown in FIG. 1, wherein the outboard motor 12 is in a substantially vertical position above the water in a position whereby it does not protrude rearwardly from the swim platform any considerable distance. When the outboard motor bracket 10 is in the "up" position as illustrated in FIG. 4, the horizontal axis of the pivot shaft 54 for the rear link 45 moves forwardly, a slight horizontal distance relative to the horizontal axis of the pivot shaft 51 for the front link, so as to provide an over-the-center condition which substantially locks the outboard motor bracket 10 in the "up" position shown in FIG. 4. The safety locking pin 66, however, is always used in the "up" position to assure that the outboard motor bracket 10 remains in a safe "up" position. The locking pin 66 may also be employed when the outboard motor bracket 10 is in the lowered position, as shown in FIGS. 2 and 4, so as to prevent accidental upward movement of the outboard motor bracket 10 during use of the outboard motor 12.

After removing the outboard motor 12, the outboard motor bracket 10 may be quickly and easily removed from the swim platform 11 by merely releasing the retainer bolt 34 from the nut 42, and swinging the front end of the bracket upwardly and moving the entire bracket rearwardly, so as to slide the locking horizontal plate 24 clear of the trailing end of the swim platform 11, and then manually lifting up the bracket 10. FIG. 3 shows the outboard motor bracket 10 sitting on the deck 78 of a power boat 79, and in a stored position with the locking pin 66 in a locking position to hold the links 44 and 45 against any accidental movement.

What is claimed is:

1. A removable outboard motor bracket adapted to be detachably mounted on a swim platform on the rear end of a power boat, including:
   (a) a mounting means adapted to be seated on the swim platform;
   (b) retaining means for detachably securing the mounting means on the swim platform;
   (c) a linkage assembly pivotally attached to said mounting means; and,
   (d) an outboard motor mounting pad mounted on an attachment means which is pivotally supported by said linkage assembly, and wherein said linkage assembly is movable manually between a lowered position, where an outboard motor carried on said mounting pad is in an operative position, and a raised position where the outboard motor is held in a vertical inoperative position.

2. A removable outboard motor bracket as defined in claim 2, including:
   (a) means for locking the linkage assembly in the lowered and raised positions.

3. A removable outboard motor bracket adapted to be detachably mounted on a swim platform on the rear end of a power boat, including:

(a) a mounting means adapted to be seated on the swim platform;
(b) retaining means for detachably securing the mounting means on the swim platform;
(c) a linkage assembly pivotally attached to said mounting means;
(d) an outboard motor mounting pad mounted on an attachment means which is pivotally supported by said linkage assembly, and wherein said linkage assembly is movable manually between a lowered position, where an outboard motor carried on said mounting pad is in an operative position, and a raised position where the outboard motor is held in a vertical inoperative position;
(e) means for locking the linkage assembly in the lowered and raised positions;
(f) said linkage assembly includes a front elongated link, and a rear elongated link which is shorter in length than the front link;
(g) said links each having a lower end pivotally mounted on said mounting means with said link lower ends being longitudinally spaced apart, with the lower end of the front link positioned forwardly of the lower end of the rear link;
(h) said outboard member mounting pad attachment means being substantially vertically disposed in both the lowered and raised positions; and,
(i) the upper ends of the front and rear links being pivotally connected to the outboard motor mounting pad attachment means with the rear link upper end being disposed below and apart from the front link upper end.

4. A removable outboard motor bracket as defined in claim 3, wherein:

(a) said means for locking the linkage assembly in the lowered and raised positions includes a locking lever having a lower end pivotally mounted on the outboard motor mounting pad attachment means on a pivot axis common to a pivot axis for the rear link, and having an upper end slidably mounted in a slot in the upper link; and,
(b) a locking pin adapted to be selectively inserted through holes in the locking lever and front link when the linkage assembly is in the lowered and raised positions.

5. A removable outboard motor bracket as defined in claim 3, wherein:

(a) said retaining means includes a transverse retainer plate means on the rear end of the mounting means and adapted to slide under the rear end of a swim platform; and,
(b) retainer bolt and nut means on the front end of the mounting means and adapted to releasably secure the front end of the mounting means on a swim platform.

6. A removable outboard motor bracket as defined in claim 5, wherein:

(a) said retaining means further includes at least one retainer member on the lower side of the mounting means and adapted to be seated in an opening in the swim platform.

7. A removable outboard bracket as defined in claim 3, wherein:

(a) an assist spring means is operatively mounted on said mounting means and engages said front link to assist movement of the linkage assembly from the lowered position to the raised position.

* * * * *